US009030322B2

(12) United States Patent
Johnson et al.

(10) Patent No.: US 9,030,322 B2
(45) Date of Patent: May 12, 2015

(54) METHOD AND APPARATUS FOR SECURELY DISPLAYING MEDIA PRODUCTS

(71) Applicant: Target Brands, Inc., Minneapolis, MN (US)

(72) Inventors: Blake M. Johnson, St. Paul, MN (US); William Donald Splain, Brooklyn Park, MN (US); David Joseph Floersch, Brooklyn Park, MN (US); Joseph H. Bowser, Minneapolis, MN (US); William Y. Stafford, Minnetrista, MN (US)

(73) Assignee: Target Brands, Inc., Minneapolis, MN (US)

( * ) Notice: Subject to any disclaimer, the term of this patent is extended or adjusted under 35 U.S.C. 154(b) by 243 days.

(21) Appl. No.: 13/858,717

(22) Filed: Apr. 8, 2013

(65) Prior Publication Data

US 2013/0227828 A1 Sep. 5, 2013

Related U.S. Application Data

(62) Division of application No. 12/545,387, filed on Aug. 21, 2009, now Pat. No. 8,413,821.

(51) Int. Cl.

| | |
|---|---|
| ***G08B 13/14*** | (2006.01) |
| ***A47B 96/02*** | (2006.01) |
| ***A47F 3/00*** | (2006.01) |
| ***A47F 7/024*** | (2006.01) |

(52) U.S. Cl.

CPC ..... *A47B 96/02* (2013.01); *Y10T 29/49815* (2015.01); *A47F 3/002* (2013.01); *A47F 7/0246* (2013.01)

(58) Field of Classification Search

CPC . E05B 73/0017; E05B 73/0011; E05B 63/00; G08B 13/1445; G08B 13/12

USPC ..... 340/568.2, 572.1, 691.1, 687; 211/4, 211/49.1, 90.01

See application file for complete search history.

(56) References Cited

U.S. PATENT DOCUMENTS

| | | | |
|---|---|---|---|
| 691,990 | A | 1/1902 | Warren |
| 3,138,261 | A | 6/1964 | Witteborg |
| 3,575,478 | A | 4/1971 | Szobski |
| 3,644,010 | A | 2/1972 | Murphy |
| 3,760,952 | A | 9/1973 | White |
| 3,915,306 | A | 10/1975 | Desisto et al. |
| 4,573,749 | A | 3/1986 | Massaro |
| 5,405,193 | A | 4/1995 | Herrenbruck |
| 5,598,728 | A | 2/1997 | Lax |

(Continued)

*Primary Examiner* — Phung Nguyen

(74) *Attorney, Agent, or Firm* — JoAnn M. Seaton; Griffiths & Seaton PLLC

(57) ABSTRACT

A method of using a security display apparatus for media content products in a retail store is disclosed. The method includes arranging sample media content containers in a side-by-side configuration on a front lip of a security display fixture, wherein each of the sample media content containers is anchored to the security display fixture with a security cable. The method further includes unlocking an access door of the security display fixture, in response to a consumer request, to provide access to an internal space defined by the security display fixture rearward of the sample media content containers, and retrieving one or more non-tethered media content containers from the internal space that are of a same title as one of the sample media content containers positioned immediately in front of the one or more non-tethered media content containers.

18 Claims, 8 Drawing Sheets

(56) References Cited

U.S. PATENT DOCUMENTS

| | | | | |
|---|---|---|---|---|
| 5,762,187 | A | 6/1998 | Belden, Jr. et al. | |
| 6,581,421 | B2 | 6/2003 | Chmela et al. | |
| 6,955,267 | B2 | 10/2005 | Taylor et al. | |
| 7,015,596 | B2 * | 3/2006 | Pail | 307/28 |
| 7,053,774 | B2 | 5/2006 | Sedon et al. | |
| 7,209,038 | B1 * | 4/2007 | Deconinck et al. | 340/568.8 |
| 7,287,652 | B2 * | 10/2007 | Scholen et al. | 211/26 |
| 7,385,522 | B2 | 6/2008 | Belden, Jr. et al. | |
| 7,641,072 | B1 | 1/2010 | Vlastakis et al. | |
| 7,667,601 | B2 * | 2/2010 | Rabinowitz et al. | 340/568.2 |
| 7,971,845 | B2 * | 7/2011 | Galant | 248/551 |
| 8,523,122 | B2 * | 9/2013 | Johnson et al. | 248/161 |
| 2003/0106867 | A1 | 6/2003 | Caterinacci | |
| 2004/0060944 | A1 | 4/2004 | Gervasi | |
| 2005/0189369 | A1 | 9/2005 | Vlastakis et al. | |
| 2007/0029340 | A1 | 2/2007 | Nagelski et al. | |
| 2007/0229259 | A1 * | 10/2007 | Irmscher et al. | 340/568.2 |
| 2009/0033456 | A1 | 2/2009 | Castillo et al. | |
| 2009/0033492 | A1 * | 2/2009 | Rapp et al. | 340/568.8 |
| 2009/0294390 | A1 | 12/2009 | Weshler | |

* cited by examiner

METHOD AND APPARATUS FOR SECURELY DISPLAYING MEDIA PRODUCTS

CROSS-REFERENCE TO RELATED APPLICATION

This application is a divisional of and claims priority under 35 U.S.C. §120 to U.S. patent application Ser. No. 12/545,387, filed Aug. 21, 2009, which is incorporated herein in its entirety.

BACKGROUND OF THE INVENTION

Display fixtures can be used in retail stores or other environments to present various products to consumers. The display fixtures may retain products for consumers to purchase, or display products or images of products for consumers to view. For example, electronic media, such as video games, DVDs, computer software, or CDs may be supported by a display fixture. Such a display fixture can be arranged along an aisle in a store so that consumers walking by the display fixture can view selected media contort products. In some instances, security measures are taken to prevent the theft of various consumer goods. Some retailers may use specialized security packaging to retain consumer goods and prevent theft of the goods.

For example, some retail stores may prevent the theft of video game containers by placing every video game container in a generally transparent box having a security alarm tag attached thereto. As such, the store workers are required to insert each video game on the sales floor into one of the security boxes before it is placed on a shelf or rack for display. When a consumer decides to purchase a selected video game, a store worker uses a specialized tool to open the transparent security box and remove the video game container for the consumer. Such a security process can require a significant amount of labor time because a security box is required for nearly every game on the sales floor that will be purchased by consumers.

In some circumstances, a retail store may display only the video game containers with the actual media disc removed from the container. As such, the consumers are essentially browsing and handling empty video game containers. When a consumer decides to purchase a selected video game, the store worker retrieves the media disc that corresponds to the video game container and inserts the media disc into the container after the transaction is complete. While this process does not necessarily require security alarm tags or transparent boxes, there is a substantial labor cost in removing each game from its container and then reinserting each game into its container at a later time. Further, there is a likelihood that one of the video game containers or media discs may be misplaced or stolen so that the retail store is left with an unmatched pair of items. Additionally, removing video game discs from their respective containers may require that shrink wrap, security strips, or other original packaging be removed from the video game containers.

Other retail stores may display all of the video games inside a secure display shelf having a generally transparent front low. Consumers may view the front of the video game containers through the front window of the secure display shelf. When a consumer decides to purchase a selected video game, the store worker must unlock the front window of the secure display shelf, retrieve the selected video game container, and then relock the display window. In such circumstances, the consumer is generally prevented from handling the video game container and viewing the rear side of the video game container until after the store worker has unlocked and retrieved the selected video game container.

SUMMARY OF THE INVENTION

In one embodiment, a method of using a security display apparatus for media content products in a retail store is utilized. The method includes arranging sample media content containers in a side-by-side configuration on a front lip of a security display fixture, wherein each of the sample media content containers is anchored to the security display fixture with a security cable. The method further includes unlocking an access door of the security display fixture, in response to a consumer request, to provide access to an internal space defined by the security display fixture rearward of the sample media content containers, and retrieving one or more non-tethered media content containers from the internal space that are of a same title as one of the sample media content containers positioned immediately in from of the one or more non-tethered media content containers.

Such method, associated apparatus, and other embodiments described herein may provide one or more of the following benefits. First, some embodiments of a display apparatus may retain video game products in a secure manner that reduces the likelihood of theft. Second, the display apparatus can permit a sample video game container to be handled by consumers so that each consumer can readily browse the front and rear faces of the sample video game container. Third, the display apparatus allows an inventory of video game containers to be collectively positioned in at least one lockable security shelf so that most of the video game containers do not require individual security boxes. Fourth, the display apparatus allows for faster stocking of video game products on the display apparatus since most of the video game products do not require individual security boxes. Fifth, each security display shelf can be removably mounted to a rear wall support without the use of handheld tools. Sixth, the security display shelves can be tiered so that lower shelves have a greater depth and retain sample video game containers in a non-vertical, angled orientation thereby making the sample video game containers readily viewable to consumers located near the display fixture.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
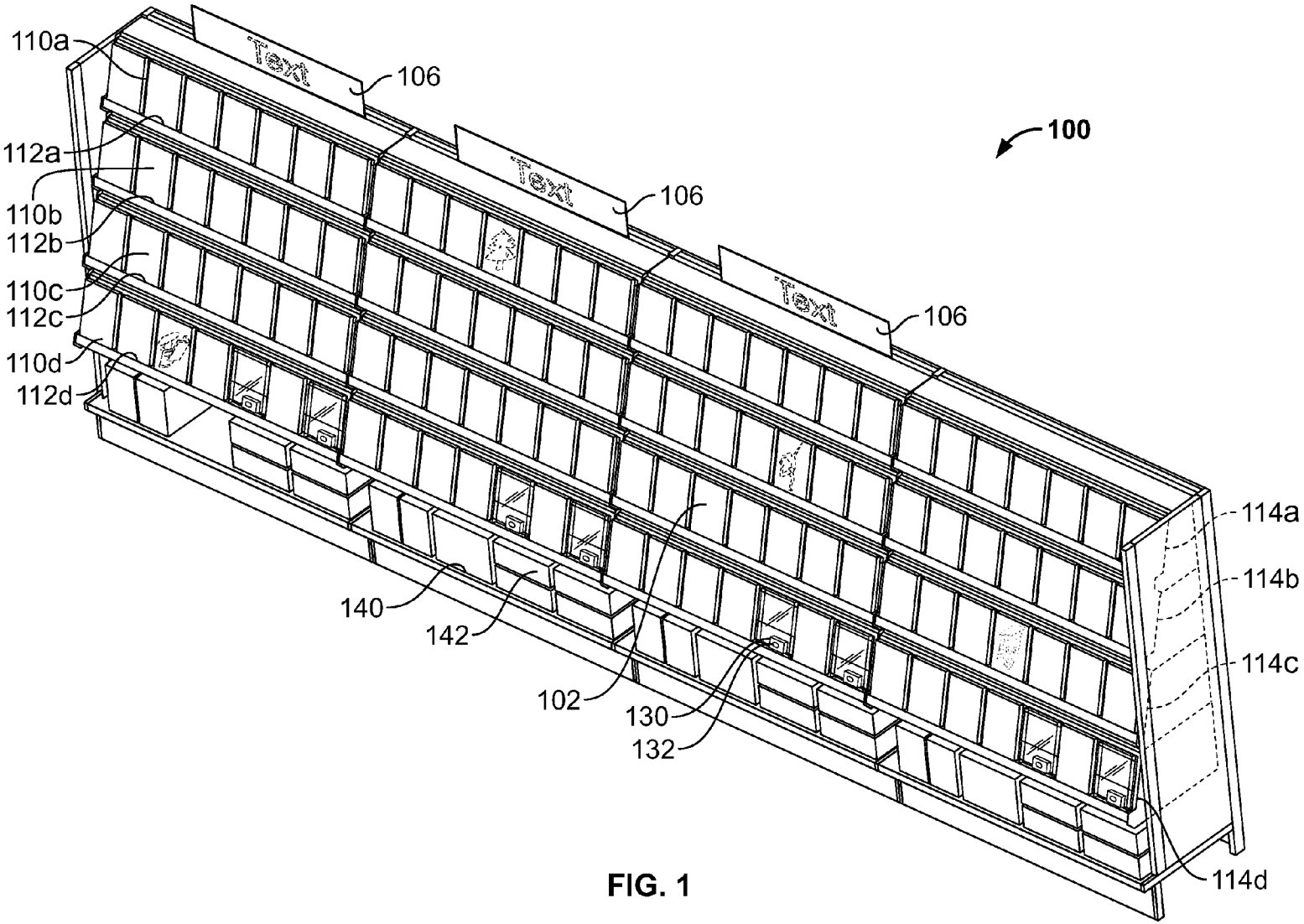
FIG. 1 is a perspective view of a display fixture for securely retaining and displaying consumer products, in accordance with some embodiments.

Referring to FIG. 1, some embodiments of a display fixture 100 include one or more display shelves 110*a-d* that are configured to retain and display a number of consumer product packages such as media content packages 102 and 108 (FIG. 3) in a secure manner. In some embodiments, the media content packages 102 and 108 are retail products containing video games, DVDs, computer software products, compact discs, or other media content items. In some embodiments, the display shelves 110*a-d* include front lip portions 112*a-d* for supporting bottom edges of sample media content packages 102 of the media content packages and angled faces 114*a-d* for supporting the sample media content packages 102 in a non-vertical orientation. In the depicted embodiment, sample video game packages 102 are placed on the display shelves 110*a-d* so that the bottom edges of the sample video game packages 102 are supported by the front lip portions 112*a-d*. The rear faces of the sample video game packages 102 are supported by the angled faces 114*a-d* so that the front faces of the sample video game packages 102 are angled upwards (e.g., toward a consumer's eyes). Such a configuration permits a consumer viewing the display fixture 100 to readily view the front faces of the sample video game packages 102 on all four display shelves 110*a-d* without having to crouch down to view the sample video game packages 102 supported by the lower shelves 110*c* and 110*d*. This non-vertical, angled orientation for the sample media content packages 102 allows the front faces of the sample media content packages 102 to be readily viewed by consumers passing by the display fixture 100, and therefore more likely to draw the attention of consumers.

Briefly, in use, the display fixture enables consumers to browse and handle a sample media content package 102 while an inventory of media content packages 108 (refer to FIG. 3) of the same type as the sample media content package 102 are arranged in one or more secure bins or secure storage enclosures 116 (refer to FIG. 3) inside one of the display shelves 110*a-d* behind the sample media content package 102. As such, a consumer can handle the sample media content package 102 and view pertinent information or graphic examples on various surfaces of the sample media content package 102. In this embodiment, the sample media content package 102 is tethered or otherwise secured to the display fixture so as to hinder theft of the sample media content package 102. If the consumer decides to purchase the media content featured by the sample media content package 102, a store worker unlocks the secure storage enclosure 116 of the display shelf (refer to FIG. 3) to retrieve one of the non-tethered media content packages 108 (of the same type as the sample media content package 102) for purchase by the consumer. Accordingly, the display fixture 100 provides the consumers with the convenience of browsing front and rear faces of the sample media content packages 102 without requiring the store workers to insert each and every media content package 108 into a separate security box or security tether system.

In some embodiments, only the sample media content packages 102 are retained within security boxes 104 while the remaining inventory of media content package 108 (FIG. 3) are not. In the depicted embodiment, the sample media content packages 102 are video game packages arranged inside generally transparent security boxes 104. Each security box 104 includes an interior cavity having height, width, and depth dimensions so as to receive and retain a video game container. Continuing with this example, each security box 104 includes generally transparent front, rear, top, bottom, and side panels to allow consumers to view information and graphics printed on the various faces of the video game container contained within. In some embodiments, a security box 104 is capable of being locked so that a sample media content package 102 contained within the security box 104 can only be removed from the security box 104 by a store worker having a particular tool or key.

Figure 2:
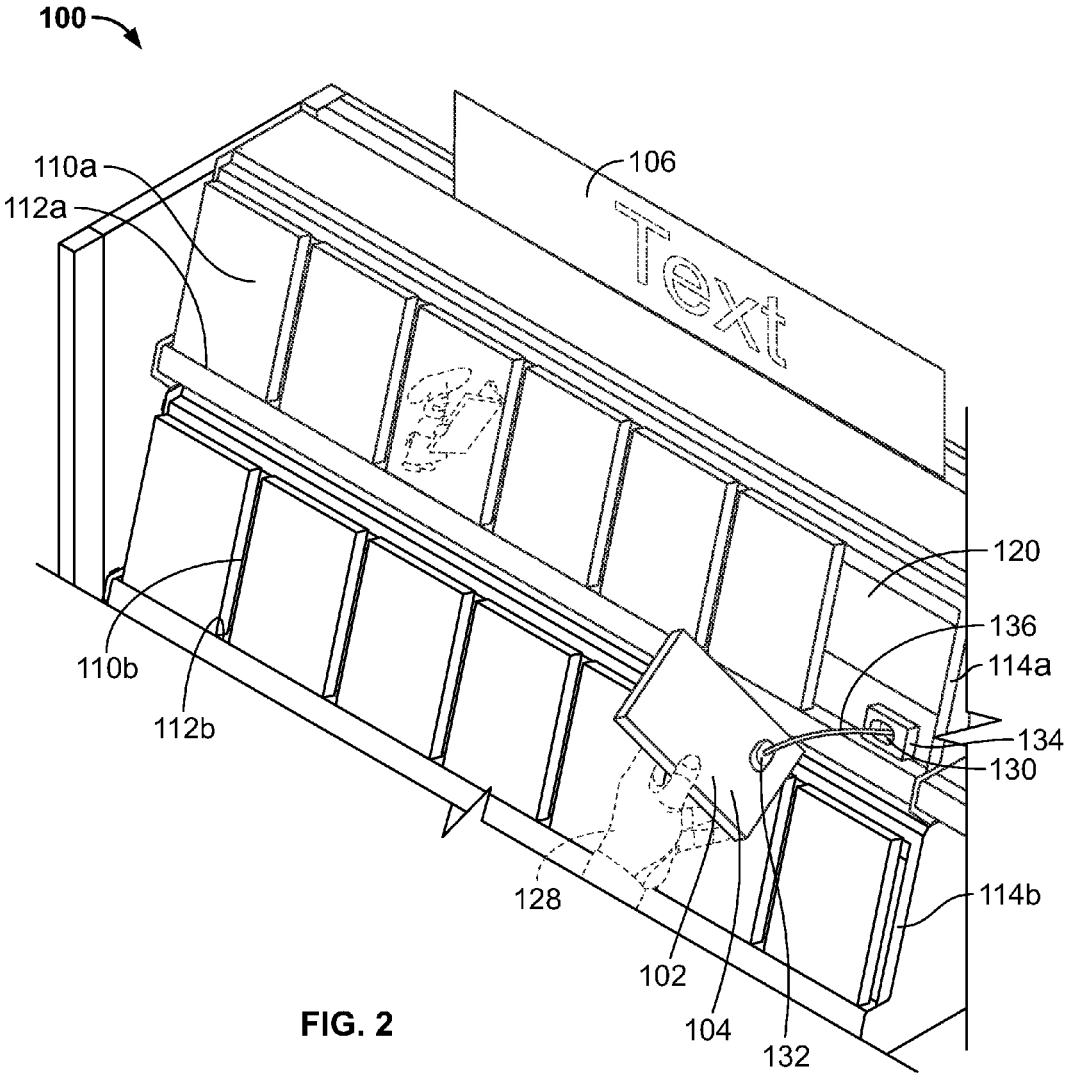
FIG. 2 is a close up view of a securing mechanism of the display fixture of FIG. 1.

Referring to FIGS. 1 and 2, in accordance with some embodiments, each of the security boxes 104 is coupled to the associated display shelf 110*i a-d* by a corresponding security tether 130. In some embodiments, each security tether 130 includes a securing portion 132 that attaches to the rear face of a security box 104 and an anchor portion 134 (FIG. 2) located behind the angled faces 114*a-d* of the display shelves 110*a-d*. The anchor portions 134 attach to the rear sides of the angled faces 114*a-d* to secure the security tethers 130 to the display shelves 110*a-d*. The security tethers 130 additionally include flexible cables 136 connecting the securing portions 132 to the anchor portions 134. In the depicted embodiment, the flexible cables 136 extend through the angled faces 114*a-d* to connect the securing portions 132 to the anchor portions 134. In some implementations, the flexible cables 136 are retractably connected to the anchor portions 134 or the securing portions 132. For example, an anchor portion 134 (FIG. 2) of a security tether 130 optionally includes a recoil spring mechanism in an interior cavity for receiving the flexible cable 136. The recoil spring mechanism optionally comprises a spring-loaded spindle that causes the flexible cable 136 to retract into the interior cavity and wrap around the spindle. Continuing with this example, when a sufficient force is applied to the securing portion 132 or the flexible cable 136 (e.g., when a consumer picks up a sample media content package 102 to view the rear side of the package 102), the flexible cable 136 unwinds from the spindle and is withdrawn from the anchor portion 134. Upon the force being removed or reduced (e.g., when the consumer returns the sample media content package 102 to the front lip portion 112*a-d*), the flexible cable 136 is retracted back into the interior cavity of the anchor portion 134 as it winds around the spring-loaded spindle therein. In some implementations, the flexible cables 136 are coiled "self-springing" cables configured to create a self-retracting effect. For example, the flexible cables 136 have a construction similar to a self-springing telephone cables, and the flexible cable 136 will thereby retract the sample media content packages 102 towards the display shelves 110*a-d*. In such implementations, recoil spring mechanisms are not necessary for retracting the flexible cables 136.

In some embodiments, the security tethers 130 allow consumers to handle and inspect the sample media content packages 102 without being able to separate the media content packages 102 from the display fixture 100. For example, a consumer 128 can approach the display fixture 100 and identify a sample media content package 102 to inspect for possible purchase. The consumer 128 may grasp one of the sample media content packages 102 and remove the selected package 102 from the front lip portion 112*a-d* of one of the display shelves 110*a-d*. The security tether 130 connected to the security box 104 secures the sample media content package 102 to the display fixture 100, thereby preventing the consumer 128 from removing the sample media content package 102 from the display fixture 100. As the consumer 128 removes the sample media content package 102 from the display shelf 110, the flexible cable 136 of the security tether 130 uncoils from the anchor portion 134 (FIG. 2) and extends through an opening in the angled face 114 of the display shelf 110. In some embodiments, the flexible cable is sufficiently long to allow an adult consumer of average height to handle the sample media content package 102 while standing upright. The consumer 128 is able to view product information and graphics displayed on the sample media content package 102 through the security box 104 that lockingly retains the sample media content package 102.

For example, if the sample media content package 102 contains a CD, the consumer 128 can view an artist name and album title shown on the front of the CD case and track listing information shown on the back of the CD case. As another example, if the sample media content package 102 contains a video game, the consumer 128 can view a title of the video game and graphics associated with the video game that are shown on the front of the sample media content package 102 and turn the sample media content package 102 around to view information displayed on the back of the sample media content package 102, such as game play features, or recommended ages for the video game. The security tether 130 allows the consumer 128 to inspect the sample media content package 102 while maintaining the security of the sample media content package 102 attached to the display fixture 100. In some embodiments, the security box 104 securely retains the sample media content package 102 so that the sample media content package 102 is not readily removable from the security box 104. Alternatively, the sample media content package 102 may not be contained within a security box 104. In such circumstances, the security tether 130 is directly connected to the sample media content package 102 (rather than the security box 104) in order to secure the sample media content package 102 to the display fixture 100.

After the consumer 128 inspects the sample media content package 102, the consumer 128 can return the sample media content package 102 back onto the front lip portion 112*a-d* of one of the display shelves 110*a-d*. In some embodiments, as the consumer 128 places the sample media content package 102 back onto the display fixture 100, the flexible cable 136 associated with the sample media content package 102 is biased to wind back into the anchor portion 134 of the security tether 130 located behind the angled face 114*a-d* of the display fixture 100.

In addition to securing the sample media content packages 102 to the display fixture 100, the security tethers 130 also ensure that the sample media content packages 102 remain in a predetermined order. In alternative embodiments without such security tethers 130 for the sample packages 102, consumers may be able to remove the sample media content packages 102 and replace them on the shelf in different positions. In the depicted embodiment, the security tethers 130 help to define a designated position on the display fixture 100 for each of the sample media content packages 102. For example, in some embodiments the security tethers 130 are generally equally spaced apart along the display shelves 10*a-d*, with the anchor portions of the security tethers 130 being attached to the display shelves 110 at regular intervals. In such circumstances, the flexible cables 136 can recoil into the anchor portions 134 to hold the sample media content packages 102 in an operative display position when the sample media content packages 102 are not being inspected or otherwise handled by a consumer or store worker. By defining an operative display position for each sample media content package 102, the security tethers 130 provide an orderly and aesthetic appearance for the display fixture 100, as shown for example in FIGS. 1 and 2.

In particular embodiments, if the sample media content packages 102 include video game media content, a store worker can arrange the sample media content packages 102 so that related video games are placed near each other. For example, the store worker can arrange the sample media content packages 102 so that sports related video games are placed near each other, puzzle-based games are placed near each other, role playing games are placed near each other, and racing games are placed near each other. As another example, the video games can be grouped by recommended age level for the games, with games for young children arranged on one end of the display fixture 100 and games for adults arranged at the other end of the display fixture 100. As another example, the best selling or most popular titles can be placed in a highly visible position on the display fixture, such as in the middle of the top display shelf 110*a*. As yet another example, newly released video games can be placed in a special new releases section. Following with this example, the display fixture 100 can optionally include a sign 106 indicating that video games located under the sign 106 are new releases.

Still referring to FIGS. 1 and 2, the display fixture 100 in this embodiment includes one or more signs 106 for conveying product information to consumers. As an example, the sign 106 includes text indicating that video games displayed on the display fixture 100 are in a particular genre or for a particular game console. As another example, the sign 106 may include text indicating that the media content packages 108 are all priced at a specific sales price. The front lips portions 112*a-d* are optionally equipped with pricing signage, such a product label strip to receive labels indicative of product information and pricing information. Also, as shown in FIG. 1, some embodiments of the display fixture 100 can include one or more shelves 140 for retaining accessory products 142. In this embodiment, the accessory products 142 are related to the sample media content packages 102. For example, if the sample media content packages 102 are video games, the accessory products 142 displayed on the unlocked shelves 140 can include video game controllers, video game consoles, video game branded apparel, or other video game related merchandise.

Figure 3:
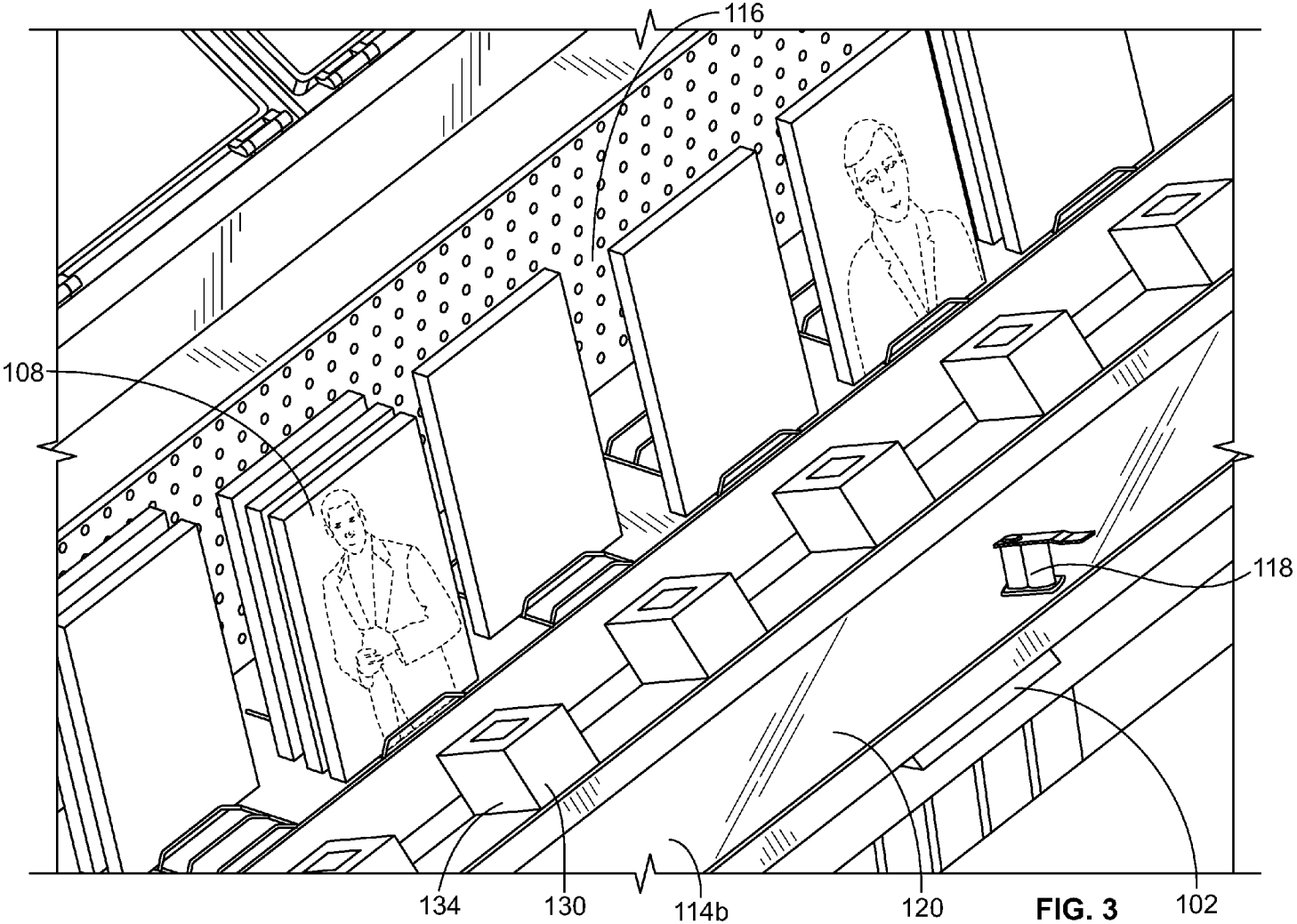
FIG. 3 is a close up view of a storage bin of the display fixture of FIG. 1.

Referring now to FIGS. 2-3, in accordance with some embodiments, an inventory of the media content packages 108 represented by the sample media content packages 102 are accessible by unlocking the display shelves 110*a-d* and accessing storage enclosures 116 (FIG. 3) disposed within each display shelf 110*a-d*. For example, a consumer can inspect one or more sample media content packages 102 that are tethered to the display fixture 100 as described above and make a determination to purchase one or more media titles. When the consumer informs a store worker that he or she will purchase one of the media content products displayed by the sample media content packages 102, the store worker unlocks one of the display shelves 110*a-d* to access additional copies of the media content packages 108. For example, referring to FIG. 3, the display shelf 110*b* may include a locking mechanism 118 and the store worker may use a key or a radio frequency identification (RFID) tag to unlock the display shelf 110*b*. The store worker opens the selected display shelf 110 to access a storage enclosure 116 disposed behind the angled face 114 of that shelf 110. The storage enclosure is configured to retain a plurality of media content packages 108 that are similar to the sample media content packages 102 arranged on the front lip 112 of the particular shelf 110. After the store worker removes the selected media content package 108 from the enclosure, the store worker then provides the non-tethered package 108 to the consumer. In some embodiments, the store worker provides the selected media content package 108 to the consumer, and the consumer thereafter takes the media content package 108 to a designated register in order to purchase the package 108. In other embodiments, the store worker carries the selected media content package 108 to a designated register before the consumer can handle the package 108.

Continuing with the above example, in some embodiments, after removing the selected media content package 108 from one of the storage enclosures 116 of the display shelf 110, the store worker closes the storage enclosure 116. In some embodiments, an access door 120 of the storage enclosure 116 will automatically lock upon being closed. In other embodiments, the store worker locks the access door 120 of the storage enclosure 116 after closing the storage enclosure (e.g., using a key).

Still referring to FIGS. 2-3, the angled faces 114*a-d* serve as the access doors 120, which are movably coupled to the display shelves 110*a-d* by hinges positioned at the bottoms of the angled faces 114*a-d*. In such embodiments, each storage enclosure can be accessed by pulling upon the top of a corresponding one of the angled faces 114*a-d*, causing the access door 120 to pivot about a horizontal hinge axis to an opened position. This front accessibility allows media content packages 108 stored in the storage enclosures 116 to be readily accessed by a store worker without the store worker requiring access to a rear or side portion of the display fixture 100. Accordingly, the display fixture 100 can be mounted against a wall or back to back with another similar display fixture without inhibiting the functionality of the display fixture 100. The display fixture 100 also prevents a store worker from having to retrieve additional copies of media content packages 108 from a back storage room or other remote area of the store because the non-tethered packages 108 are stored in close proximity to the sample media content packages 102 displayed on the front of the display shelves 110*a-d*.

Referring to FIG. 3, in some embodiments, the sample media content packages 102 are retained in position on the display shelves 110*a-d* by the security tethers 130 when the access doors 120 are in the open position. For example, the anchor portions 134 of the security tethers 130 may be spring-loaded or contain other mechanisms to impart tension about the flexible cables 136 of the security tethers 130. The tension imparted on the flexible cables 136 can be sufficient to counteract the force of gravity on the sample media content packages 102 so that the sample media content packages 102 are retained in the same position on the display shelves 110*a-d* even when the angle faces 114*a-d* are hingedly adjusted to an open position.

Still referring to FIG. 3, in some embodiments, the media content packages 108 arranged within the storage enclosures 116 are arranged to align behind the corresponding sample media content packages 102 displayed on the front lips 112*a-d* of the display shelves 110*a-d*. For example, if the sample media content packages 102 include video game products, a supply of the same video game packages 108 are contained within the storage enclosures 116 behind the sample media content packages 102 having the same title. Such a configuration allows a store worker to readily identify the location of a desired media content package 108 contained within the storage enclosures. In some embodiments, the media content packages 108 are arranged at an angle so that the media content packages 108 are substantially parallel to the sample media content packages 102 when the sample media content packages 102 are arranged on the front lip portions 112*a-d* and the access doors is closed.

Figure 4A:
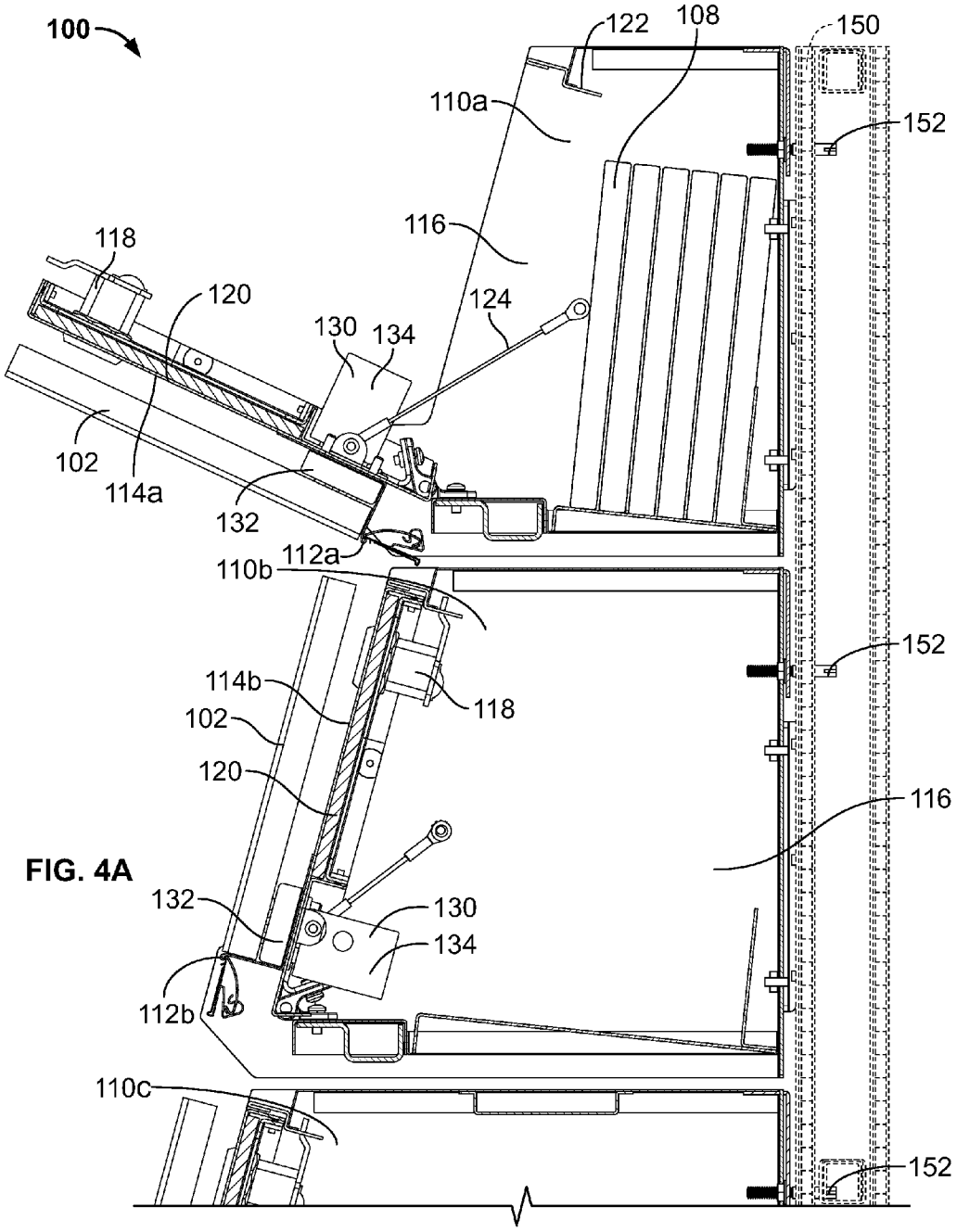
FIG. 4A is a side view of a portion of the display fixture of FIG. 1.
Figure 4B:
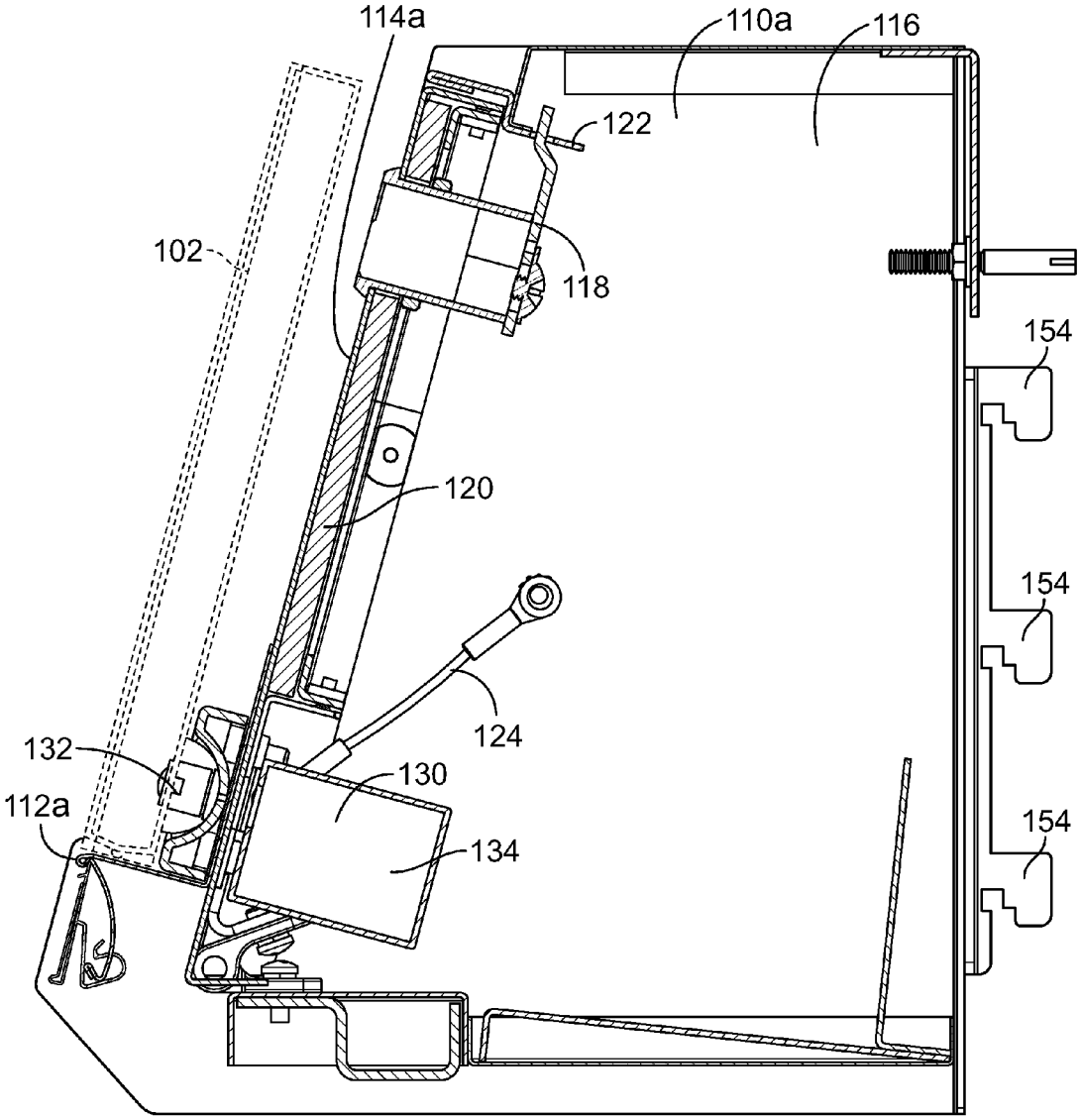
FIG. 4B is a cross-sectional view of a shelf and a storage bin of the display fixture of FIG. 1.
Figure 5A:
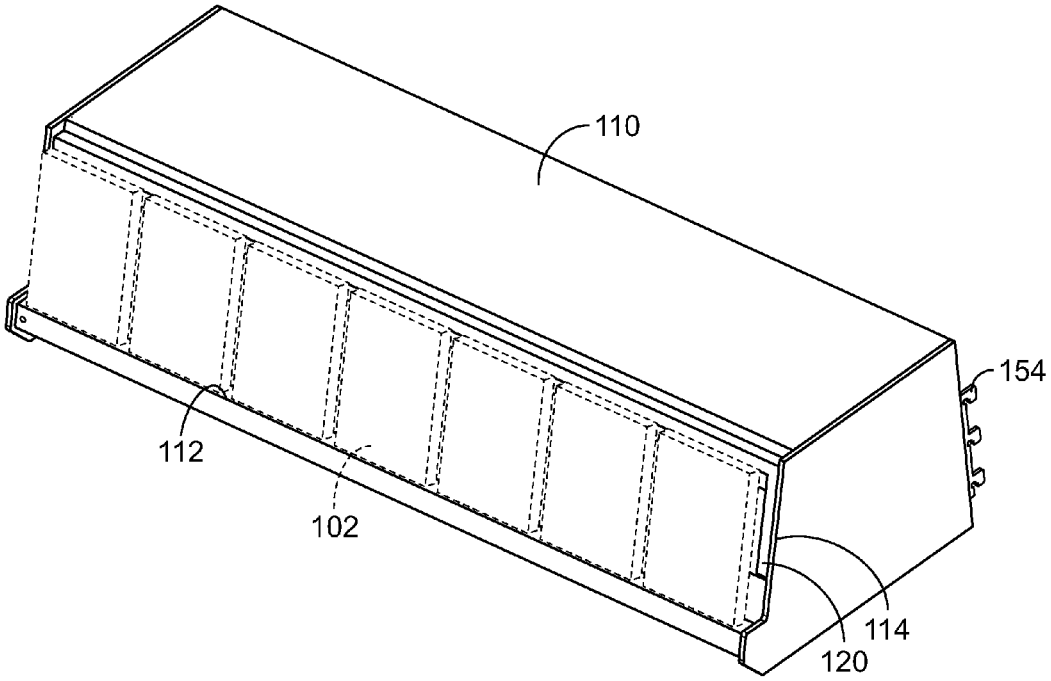
FIG. 5A is a perspective view of a shelving unit of the display fixture of FIG. 1.
Figure 5B:
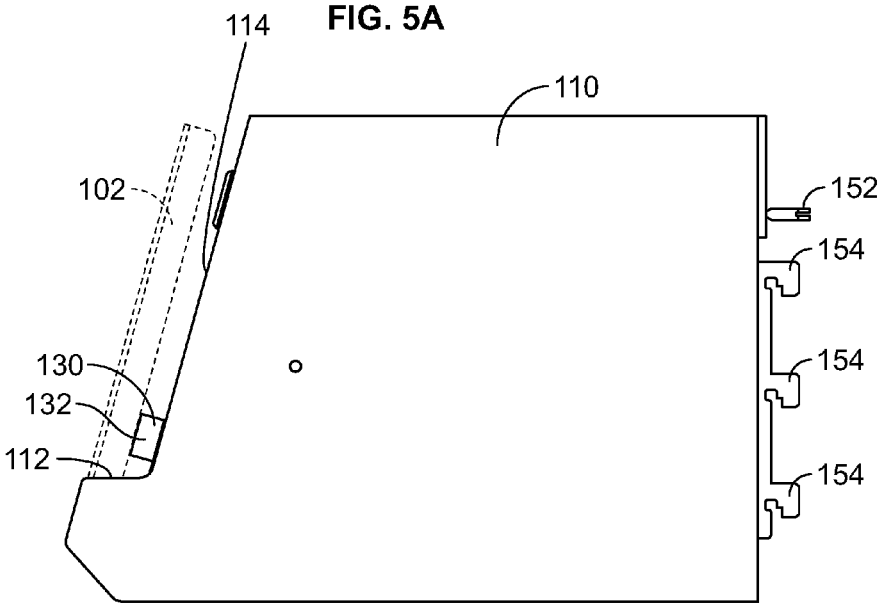
FIG. 5B is a side view of a shelving unit of the display fixture of FIG. 1.
Figure 5C:
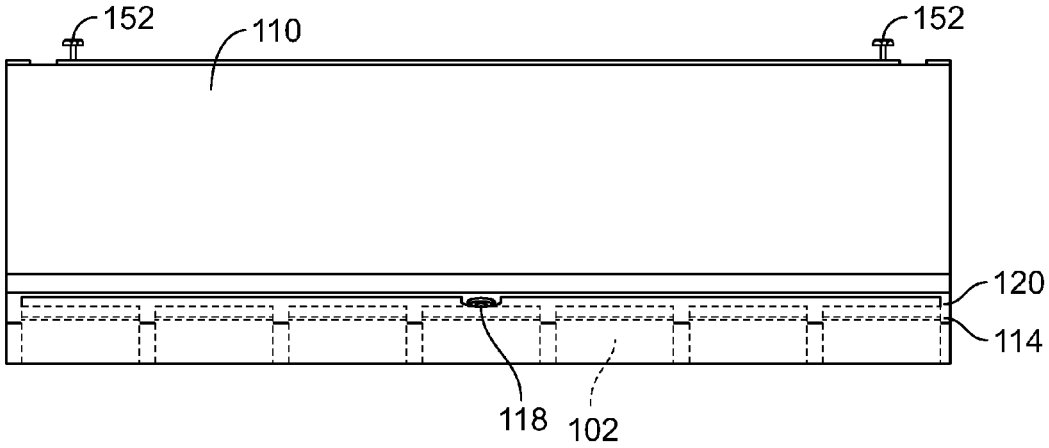
FIG. 5C is a top view of a shelving unit of the display fixture of FIG. 1.
Figure 5D:
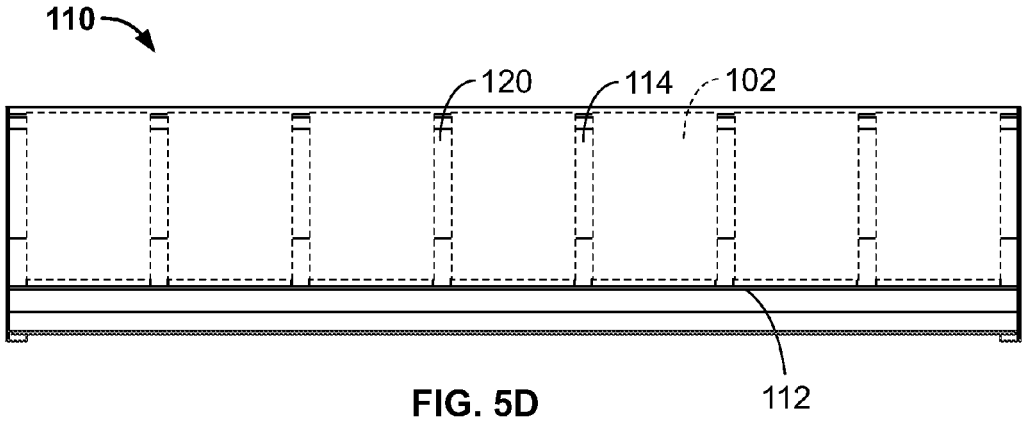
FIG. 5D is a front view of a shelving unit of the display fixture of FIG. 1.

Referring now to FIGS. 4A-B, in accordance with some embodiments, the display shelves 10*a-d* are individually attached to a support wall 150 of the display fixture 100. In some embodiments, as shown in FIG. 4A, fasteners 152 are used to secure the display shelves 10*a-d* in place on the support wall. Alternatively, as shown in FIG. 4B, the display shelves 110*a-d* include one or more tabs or hooks 154 extending rearwardly from the back of the display shelves. The support wall 150 can include slots for receiving the hooks 154. In such instances, the hooks 154 can securely hold the display shelves 110*a-d* in place with relation to the support wall 150 without the need for tools or fasteners. The modular design of the display fixture 100 allows for display shelves 110 to be added or removed from the display fixture 100 in order to change the appearance of the display fixture 100. For example, referring to FIG. 1, an additional display shelf can be positioned below the display shelf 110*d* in place of the unlocked shelf 140. As another example, the display shelf 110*a* can be removed from the display fixture 100 and replaced with signage or other information or product display devices.

Referring again to FIGS. 4A-B, the display shelves 110*a-d* may be arranged in a vertical array with the display shelf 110*a* positioned above the display shelf 110*b*, the display shelf 110*b* positioned above the display shelf 110*c*, and so on. In the depicted embodiment, each display shelf 110*a-d* has a greater depth than the display shelf 110*a-d* positioned immediately above it. For example, the display shelf 110*b* has a greater depth than the display shelf 110*a*. Each display shelf extends away from the support wall 150 such that the front faces of the sample media content packages 102 are substantially coplanar when the access doors 120 of the display shelves 110*a-d* are in a closed position and the sample media content packages 102 are in an operative position on the front lip portions 112*a-d*. This configuration increases the viewability of the lower shelves 110*c-d* because the higher display shelves 110*a-b* do not block the line-of-sight to the sample media content packages 102 positioned on the lower display shelves 110*c-d*. In some circumstances, positioning the sample media content packages 102 so that their front faces are substantially coplanar improves the aesthetic appeal of the display fixture 100 and provides visibility of all of the sample media content packages 102 to a consumer standing in front of the display fixture 100.

As described above, in some embodiments, the media content packages 108 located within the storage enclosures 116 are accessed by drawing the tops of the access doors 120 outward, away from the support wall 150. In some embodiments, the lock 118 must be unlocked before the access door 120 can be opened. For example, each display shelf 110*a-d* can include a lock receiving mechanism 122 for receiving a portion of the lock 118 and securing the access door 120 in a closed position when the lock 118 is in a locked position. In the embodiment depicted in FIG. 4A, when the access door 120 of the display shelf 110*a* is opened, the sample media content packages 102 supported by the display shelf 110*a* are held in position with relation to the access door 120 by security tethers 130. The anchor portions 134 of the security tethers 130 extend rearwardly from the access door 120. The recoil spring mechanisms retained within the anchor portions 134 create tension on the flexible cables 136 in order to hold the sample media content packages 102 in position on the front lip portion 112*a* when the access door 120 is in an open position.

Still referring to FIGS. 4A-B, in accordance with some embodiments, each display shelf 110*a-d* includes a door support cable 124 for holding the access door 120 in a specified position when the access door 120 is open. The door support cable 124 can be attached to the access door 120 and anchored to an inner side wall of the display shelf 110*a-d*. The door support cable 124 can hold the access door 120 in place while a store worker accesses media content packages 108 retained within the storage enclosure 116. Also, the door support cable 124 may prevent the access door 120 from being opened beyond a specified angle.

Referring now to FIGS. 5A-5D, in some embodiments, each display shelf 110 is an individual unit that can be attached to a support wall 150 to create a modular display fixture (e.g. the display fixture 100). The angled face 114 of the display shelf 110 holds the sample media content packages 102 at a non-vertical angle so that the front faces of the sample media content packages 102 are viewable by a consumer standing near the shelf and looking at the display shelf 110 in a downward manner. The access door 120 allows access to media content packages 108 stored within an internal storage enclosure 116 of the display shelf 110. In some embodiments, the access door 120 includes a lock 118 so that only authorized personnel are able to access the internal enclosure. Display shelves 110 of various depths can be arranged in a vertical array on a support wall such that the sample media content packages 102 supported by the display shelves 110 are substantially aligned.

In some embodiments, multiple display shelves 110 can be positioned side-by-side on one or more support walls 150 in order to create a display fixture that is longer than a single display shelf 110 (e.g. the display fixture 100 shown in FIG. 1). As previously described, each shelf may include a plurality of fasteners 152 (FIG. 5B) to secure the display shelf 110 in a selected position on a rear support wall. In addition or in the alternative, the display shelf 110 can include one or more tabs or hooks 154 (FIG. 5B) extending rearwardly from the shelf 110 so as to toollessly mount to a rear support wall. As previously described, the support wall 150 can include slots for receiving the hooks 154. In such instances, the hooks 154 can securely hold the display shelves 110*a-d* in place with relation to the support wall 150 without the need for handheld tools during installation. Because each shelf 110 can be installed adjacent to other similar shelves, the display fixture 100 can be assembled in a modular fashion to accommodate store aisles of different sizes.

Figure 6:
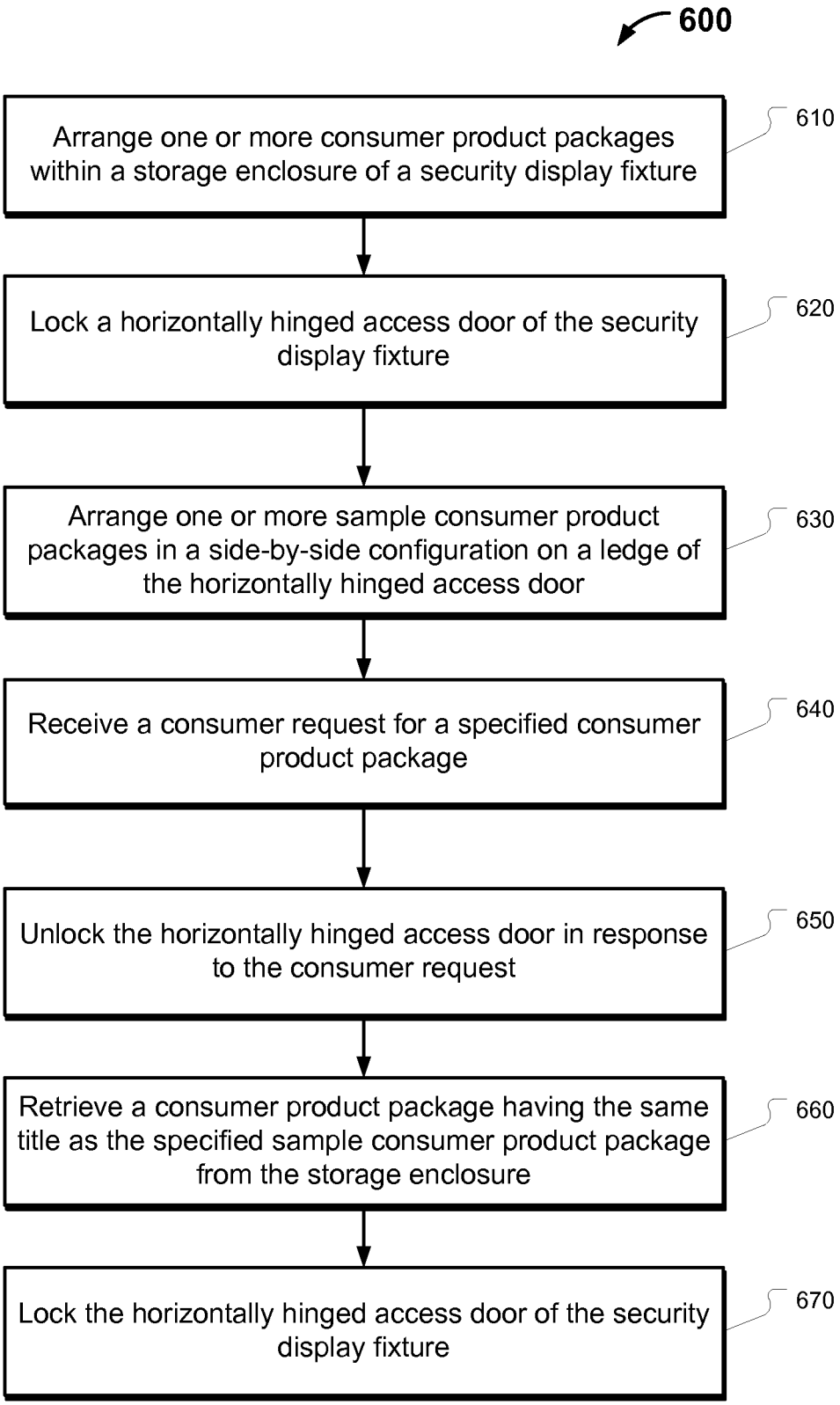
FIG. 6 is a flow chart of an example method for securely displaying consumer products on a display fixture.

Referring now to FIG. 6, some embodiments of a process 600 for displaying media content packages on a display fixture can include an operation 610 of arranging one or more consumer product packages (e.g. media content packages 108) within a storage enclosure of a security display fixture. For example, as shown in FIG. 3, the media content packages 108 can be arranged within the storage enclosure 116. In some instances, the media content packages 108 are arranged so that the media content packages 108 are grouped by category, genre, or recommended age level. For example, if the media content packages 108 contain video games, the video games can be grouped according to genre, such as action games, role playing games, puzzle based games, and sports games.

In operation 620, a user locks a horizontally hinged access door of the security display fixture. For example, as shown in FIG. 4A, a store worker can close the access door 120 of the display shelf 110*a* and lock the access door 120 in a closed position using the lock 118. In some embodiments, the access door 120 requires a key or other locking device to be locked. In other embodiments, the access door 120 will lock automatically upon being closed.

In operation 630, a user arranges one or more sample consumer product packages in a side-by-side configuration on a ledge of the horizontally hinged access door. For example, referring to FIG. 1, a store worker can place sample media content packages 102 within corresponding security boxes 104. The store worker can place the sample media content packages 102 side-by-side on the front lip portions 112*a-d* of the display shelves 110*a-d*. In some embodiments, the store worker can arrange the sample media content packages 102 so that each sample media content package 102 is positioned in front of corresponding media content packages 108 positioned within the display shelf 110*a-d* having the same title as the respective sample media content package 102. In some embodiments, the sample media content packages 102 are retained on the shelf in a secure manner by security tethers 130 that are attached to the security boxes 104 and anchored to the display shelves 110*a-d*. The security tethers 130 allow consumers to inspect front, rear, side, top, and bottom surfaces of the sample media content packages 102 without being able to remove the sample media content packages 102 from the display fixture 100.

In operation 640, a user receives a consumer request for a specified consumer product package. For example, as shown in FIG. 2, a consumer can inspect one or more video games displayed by the display fixture 100 and make a decision as to a video game that he or she wishes to purchase. The consumer can then inform a store worker of the particular video game title that he or she wishes to purchase.

In operation 650, a user unlocks the horizontally hinged access door in response to the consumer request. For example, as shown in FIG. 3, the store worker can use a key, RFID tag, or specialized tool to unlock the access door 120 and access the storage enclosure 116. The storage enclosure 116 contains media content packages 108 of the same type or title as the sample media content packages 102 displayed on the outside of the display shelf 110*b*. In some embodiments, as the store worker opens the access door 120, the sample media content packages 102 are held in place on the angled face 114*b* by the security tethers 130.

In operation 660, a user retrieves a consumer product package having the same title as the specified sample consumer product package from the storage enclosure. For example, as shown in FIG. 3, the store worker can access the storage enclosure 116 and select a copy of the desired media content package 108 indicated by the consumer from the storage enclosure 116. In some embodiments, the store worker provides the selected media content package 108 to the consumer, and the consumer thereafter takes the media content package 108 to a designated register in order to purchase the media content package 108. In other embodiments, the store worker carries the selected media content package 108 to a designated register before the consumer can handle the media content package 108.

In operation 670, a user locks the horizontally hinged access door of the security display fixture. In some implementations, a store worker uses a key or specialized tool to lock the display shelf 110. In other implementations, the access doors 120 are self-locking and will automatically lock when closed. Locking the access door 120 of a display shelf 110*a-d* secures the remaining media content packages 108 within the storage enclosure 116, and thereby limits access of the media content packages 108 to consumers without the assistance of a store worker.

It should be understood from the description herein that, in alternate embodiments, consumer products other than media content products 108 can be retained and displayed by the display fixture 100. For example, the display fixture 100 can be employed to display in a secure manner items such as watches, eyeglasses, jewelry, clothing, sporting goods, computer accessories, video game console accessories, cameras, cellular phones, GPS units, or other electronic devices. Sample products may be retained in security boxes 104 and coupled to the display shelves 110*a-d* by secure tethers 130. Additional products can be obtained for purchase by opening an access door 120 of a display shelf 110 in order to access a storage enclosure 116 of the display shelf 110.

A number of embodiments of the invention have been described. Nevertheless, it will be understood that various modifications may be made without departing from the spirit and scope of the invention. Accordingly, other embodiments are within the scope of the following claims.

What is claimed is:

1. A method of using a security display apparatus for media content products in a retail store, the method comprising:

arranging sample media content containers in a side-by-side configuration on a front lip of a security display fixture, each of the sample media content containers being anchored to the security display fixture with a security cable;

in response to a consumer request, unlocking an access door of the security display fixture to provide access to an internal space defined by the security display fixture rearward of the sample media content containers;

retrieving one or more non-tethered media content containers from the internal space that are of the same title as one of the sample media content containers positioned immediately in front of the one or more non-tethered media content containers; and arranging the one or more of the non-tethered media content containers in the internal space defined by the security display fixture, each of the one or more of the non-tethered media content containers being arranged in a row generally rearward of one of the sample media content containers having the same title.

2. The method of claim 1, wherein each of the sample media content containers arranged in the side-by-side configuration is individually retained inside a generally transparent security case that is attached to the security cable extending from the security display fixture.

3. The method of claim 1, wherein arranging the sample media content containers includes placing each of the sample media content containers against a front surface of the access door, and the front lip extends forwardly from the front surface of the access door.

4. The method of claim 3, wherein unlocking the access door of the security display fixture to provide access to the internal space includes pivoting the access door about a horizontal hinge axis along the front surface to expose the internal space previously covered by the access door.

5. The method of claim 3, wherein:

arranging sample media content containers includes attaching a different security cable to each of the sample media content containers, and each of the different the security cables includes a retraction mechanism that biases the corresponding one of the sample media content containers toward the access door.

6. The method of claim 5, wherein:

unlocking the access door of the security display fixture to provide access to the internal space includes pivoting the access door about a horizontal hinge axis along the front surface, and each of the different security cables maintains the corresponding one of the sample media content containers against the front surface of the access door as the access door is pivoted about the horizontal hinge axis.

7. The method of claim 1, further comprising removably mounting a rear face of the security display apparatus to a rear support wall using a plurality of support connectors extending from the rear face.

8. The method of claim 1, wherein:

the sample media content containers is a first row of sample media content containers, the method further comprises arranging a second row of sample media content containers in a side-by-side configuration on a second front lip of the security display fixture, each of the sample media content containers in the second row of sample media content containers is anchored to the security display fixture with a different one of a second group of security cables, and the second row of sample media content containers is positioned below the first row of sample media content containers.

9. The method of claim 1, wherein the security cable allows each of the sample media content containers to be pulled away from a remainder of the security display fixture such that all sides of a selected one of the sample media content containers are readily viewable when the selected one of the sample media content containers is pulled away from the remainder of the security display fixture.

10. A method of using a security display apparatus for media content products in a retail store, the method comprising:

arranging sample media content containers in a side-by-side configuration on a front lip of a security display fixture, each of the sample media content containers being anchored to the security display fixture with a security cable;

in response to a consumer request, unlocking an access door of the security display fixture to provide access to an internal space defined by the security display fixture rearward of the sample media content containers; and retrieving one or more non-tethered media content containers from the internal space that are of the same title as one of the sample media content containers positioned immediately in front of the one or more non-tethered media content containers;

wherein:

each of the sample media content containers arranged in the side-by-side configuration is individually retained inside a generally transparent security case that is attached to the security cable extending from the security display fixture, the access door is positioned forward of the internal space defined by the security display fixture, the access door is arranged between the sample media content containers and the one or more non-tethered media content containers inside the internal space, and the operation of unlocking comprises adjusting the access door to an opened position exposing the inter internal space.

11. The method of claim 10, further comprising locking the access door after removing a selected one of the one or more non-tethered media content containers from the security display fixture.

12. The method of claim 11, further comprising transferring the selected one of the one or more of the non-tethered media content containers to a consumer during a purchase transaction.

13. A method of using a security display apparatus for media content products in a retail store, the method comprising:

arranging sample media content containers in a side-by-side configuration on a front lip of a security display fixture, each of the sample media content containers being anchored to the security display fixture with a security cable;

in response to a consumer request, unlocking an access door of the security display fixture to provide access to an internal space defined by the security display fixture rearward of the sample media content containers;

retrieving one or more non-tethered media content containers from the internal space that are of the same title as one of the sample media content containers positioned immediately in front of the one or more non-tethered media content containers;

wherein:

arranging the sample media content containers includes placing each of the sample media content containers against a front surface of the access door, the front lip extends forwardly from the front surface of the access door, unlocking the access door of the security display fixture to provide access to the internal space includes pivoting the access door about a horizontal hinge axis along the front surface to expose the internal space previously covered by the access door, and pivoting the access door about the horizontal hinge axis simultaneously moves all of the sample media content containers in the side-by-side configuration away from covering the internal space.

14. A method of using a security display apparatus for media content products in a retail store, the method comprising:

arranging sample media content containers in a side-by-side configuration on a front lip of a security display fixture, each of the sample media content containers being anchored to the security display fixture with a security cable;

in response to a consumer request, unlocking an access door of the security display fixture to provide access to an internal space defined by the security display fixture rearward of the sample media content containers; and retrieving one or more non-tethered media content containers from the internal space that are of the same title as one of the sample media content containers positioned immediately in front of the one or more non-tethered media content containers;

wherein:

the access door is arranged between the sample media content containers and the internal space, and unlocking the access door includes simultaneously moving the access door and all the sample media content containers away from a position covering the internal space.

15. A method of using a security display apparatus for media content products in a retail store, the method comprising:

arranging sample media content containers in a side-by-side configuration on a front lip of a security display fixture, each of the sample media content containers being anchored to the security display fixture with a security cable;

in response to a consumer request, unlocking an access door of the security display fixture to provide access to an internal space defined by the security display fixture rearward of the sample media content containers; and retrieving one or more non-tethered media content containers from the internal space that are of the same title as one of the sample media content containers positioned immediately in front of the one or more non-tethered media content containers;

wherein:

the access door is initially in a locked position in which a lock mechanism retains the access door immediately adjacent to and covering the internal space, and unlocking the access door includes transitioning the access door to an opened position to provide external access to the one or more non-tethered media content containers in the internal space.

16. A method of using a security display apparatus for media content products in a retail store, the method comprising:

arranging sample media content containers in a side-by-side configuration on a front lip of a security display fixture, each of the sample media content containers being anchored to the security display fixture with a security cable;

in response to a consumer request, unlocking an access door of the security display fixture to provide access to an internal space defined by the security display fixture rearward of the sample media content containers; and retrieving one or more non-tethered media content containers from the internal space that are of the same title as one of the sample media content containers positioned immediately in front of the one or more non-tethered media content containers;

wherein:

the access door is substantially transparent, arranging the sample media content containers in the side-by-side configuration substantially hides the one or more non-tethered media content containers from view through the access door, and each of the sample media content containers is configured to be selectively moved away from the access door to expose any corresponding ones of the one or more non-tethered media content containers positioned in the internal space behind the corresponding sample media content container.

17. The method of claim 16, including checking whether any corresponding one of the one or more non-tethered media content containers having the same title as a selected one of the sample media content containers is in stock by moving the selected one of the sample media content containers away from the access door to view the any corresponding one of the one or more non-tethered media content containers positioned in the internal space behind the selected one of the sample media content containers viewable through the access door.

18. A method of using a security display apparatus for media content products in a retail store, the method comprising:

arranging sample media content containers in a side-by-side configuration on a front lip of a security display fixture, each of the sample media content containers being anchored to the security display fixture with a security cable;

in response to a consumer request, unlocking an access door of the security display fixture to provide access to an internal space defined by the security display fixture rearward of the sample media content containers; and retrieving one or more non-tethered media content containers from the internal space that are of the same title as one of the sample media content containers positioned immediately in front of the one or more non-tethered media content containers;

wherein:

the security cable is retractable and biased in a retracted position, each of the sample media content containers arranged in the side-by-side configuration is individually retained inside a generally transparent security case that is attached to the security cable extending from the security display fixture such that each of the sample media content containers is selectively held against a front surface of the access door by the security cable, the access door is positioned forward of the internal space defined by the security display fixture and between the sample media content containers and the one or more non-tethered media content containers inside the internal space, the step of unlocking comprises adjusting the access door to an opened position exposing the internal space, and adjusting the access door moves more than one of the sample media content containers with the access door.

* * * * *